US007152545B2

(12) United States Patent
Sasayama et al.

(10) Patent No.: US 7,152,545 B2
(45) Date of Patent: Dec. 26, 2006

(54) MANUAL HYDRAULIC STEERING APPARATUS

(76) Inventors: Katsuhiko Sasayama, c/o Marol Co., Ltd., 2-1-34, Ohashi-cho, Nagata-ku, Kobe 653-0037 (JP); Kenichi Shimada, c/o Marol Co., Ltd., 2-1-34, Ohashi cho, Nagata-ku, Kobe 653-0037 (JP)

( * ) Notice: Subject to any disclaimer, the term of this patent is extended or adjusted under 35 U.S.C. 154(b) by 238 days.

(21) Appl. No.: 11/003,978

(22) Filed: Dec. 6, 2004

(65) Prior Publication Data

US 2006/0118022 A1 Jun. 8, 2006

(51) Int. Cl.
*B63H 25/12* (2006.01)
*B62D 1/18* (2006.01)
*B62D 5/07* (2006.01)

(52) U.S. Cl. ..... 114/144 R; 74/493

(58) Field of Classification Search ..... 114/144 R, 114/150, 154–161; 74/493, 551.3; 280/775
See application file for complete search history.

(56) References Cited

U.S. PATENT DOCUMENTS 5,836,211 A * 11/1998 Ross et al. ..... 74/493
2005/0166819 A1* 8/2005 Zeiger ..... 114/144 R

FOREIGN PATENT DOCUMENTS

JP 2000-43794 2/2000

* cited by examiner

*Primary Examiner*—Ajay Vasudeva
(74) *Attorney, Agent, or Firm*—Wenderoth, Lind & Ponack, L.L.P.

(57) ABSTRACT

A manual hydraulic steering apparatus of a vessel is provided with a tilting mechanism 1 positioned on one side of a dashboard D and a hydraulic pump 51 positioned on the other side. A tilt housing 2 is fixed to a mounting plate 3 and has an oil feeding tank 11 formed in an upper portion thereof. A semispherical shell 4 is supported turnably in all directions by the tilt housing 2. A steering shaft 5 is supported rotatably by the semispherical shell 4 and is rotatably coupled to the driving shaft 53. The steering shaft 5 is also tiltable on a horizontal axis perpendicular to the driving shaft. The hydraulic pump 51 includes a pump casing 52, which has a mounting part 52*b* extending into a larger hole D1 of the dashboard D. An oil feeding pipe 13 extends through a smaller hole D2 of the dashboard D and communicates with the oil feeding tank 11 and an oil tank 54 of the hydraulic pump 51.

3 Claims, 5 Drawing Sheets

MANUAL HYDRAULIC STEERING APPARATUS

FIELD OF THE INVENTION

The present invention relates to a manual hydraulic steering apparatus having a steering wheel and a steering shaft that can be tilted up and down so that the wheel can be operated by an operator in an optimum position. More specifically, this invention relates to a tilting mechanism for a manual hydraulic steering apparatus for steering a vessel by means of a helm pump or another hydraulic pump that develops hydraulic steering force when the steering shaft of the apparatus is turned.

BACKGROUND OF THE INVENTION

For example, FIGS. 1 and 2 of Japanese unexamined patent publication No. 2000-43794 show a steering apparatus including a hydraulic pump, a steering shaft and a tilting mechanism of the foregoing type. The tilting mechanism includes a joint coupling the steering shaft to the driving shaft of the pump tiltably in a vertical plane. The tilting mechanism and the adjacent end portion of the steering shaft are covered by a bellows cover in the form of a truncated cone, from which the other portion of this shaft protrudes. The steering apparatus is mounted on or in a vessel, with the body of the hydraulic pump extending through an opening in the dashboard of the vessel.

A major portion (the portion excluding the main unit) of the hydraulic pump and the tilting mechanism extend a large amount from the dashboard toward the stern. For this reason, they interfere with steering and are unpleasant in appearance. If a portion of the hydraulic pump and the tilting mechanism extend very greatly, they are not desirable for safety when the vessel collides, turns suddenly or stops suddenly.

FIG. 4 of the foregoing publication shows another steering apparatus as an art prior to the apparatus shown in FIGS. 1 and 2 of the publication publication. This steering apparatus includes a hydraulic pump and a tilting mechanism of the foregoing type. The tilting mechanism is separate from the hydraulic pump and includes a tilting shaft. The whole of the hydraulic pump is mounted inside the dashboard of a vessel. A mounting plate is fixed to the dashboard and has a central hole, through which the driving shaft of the hydraulic pump extends. The steering shaft is coupled to the outer end of the driving shaft. The tilting mechanism is fixed to the mounting plate.

Because this hydraulic pump, the mounting plate and this tilting mechanism are separate components, the mounting operation is complex and takes time. The hydraulic pump has an oil feeding port formed inside the dashboard. If an oil feeding passage connects the oil feeding port and the outside of the dashboard, extra parts are necessary for forming the passage. If there is no such passage, it takes time and/or is troublesome to supply oil to the oil feeding port, which is positioned inside the dashboard. It is necessary to periodically bleed the air accumulating near the oil feeding port. It takes time and/or is troublesome to bleed the air accumulating near the oil feeding port, which is positioned inside the dashboard.

SUMMARY OF THE INVENTION

The object of the present invention is to provide to a manual hydraulic steering apparatus that can be mounted on the dashboard of a vessel, the steering apparatus including a tilting mechanism not protruding greatly from the dashboard toward the stern, the tilting mechanism having an oil feeding port formed in the rear of the dashboard so that the oil feeding and air bleeding operations are easy, the tilting mechanism being able to be mounted on the dashboard relatively easily in a short time.

According to the present invention, a manual hydraulic steering apparatus is provided for a vessel, which is fitted with a dashboard having a first hole and a second hole both cut through it. The steering apparatus comprises a tilting mechanism positioned on one side of the dashboard and a hydraulic pump positioned on the other side. The tilting mechanism includes a mounting plate in contact with the dashboard. A tilt housing is fixed to the mounting plate and has an oil feeding tank formed in an upper portion thereof. The feeding tank has an oil feeding port, in which an oil plug fitted removably. A semispherical shell is supported turnably in all directions by the tilt housing. A steering shaft is supported rotatably by the semispherical shell. The hydraulic pump includes a pump casing, which has a mounting part extending into the first hole of the dashboard. An oil tank is provided in an upper portion of the hydraulic pump near the dashboard. A pumping mechanism is housed in the pump casing. A driving shaft is supported by the pump casing and rotatable so that the pumping mechanism can create hydraulic pressure for steering the vessel. The driving shaft extends through the mounting part of the pump casing and the mounting plate of the tilting mechanism. The mounting plate of the tilting mechanism is screwed to the mounting part of the pump casing. The steering shaft is coupled to the driving shaft rotatably with the driving shaft and tiltably on a horizontal axis perpendicular to the driving shaft. An oil feeding pipe extends through the second hole of the dashboard and communicates with the oil feeding tank and the oil tank.

The parts of the tilting mechanism that extend backward from the dashboard are a rear portion of the driving shaft, the tilt housing having an internal space for the semispherical shell, and the portion of the steering shaft that protrudes from this housing. These parts extend a considerably small amount as compared with a conventional steering apparatus including a hydraulic pump a major portion of which extends with a steering shaft backward from a dashboard. This prevents the tilting mechanism from interfering with steering. A steering wheel is fixed to the rear end of a conventional steering shaft, which extends a small amount backward. Accordingly, the steering wheel is very safe because the operator is not liable to hit on the wheel when the vessel turns suddenly or collides.

The oil feeding tank in the tilt housing communicates with the oil tank in the hydraulic pump. It is possible to feed oil and bleed air through the oil feeding port of the feeding tank, which is positioned in the rear of the dashboard. This makes the oil feeding and air bleeding operations easy.

It is possible to mount the tilting mechanism and the hydraulic pump on both sides of the dashboard simply, securely and firmly by inserting the mounting part of the pump casing into the first hole of the dashboard and connecting the mounting plate of the tilting mechanism to the mounting part.

The tilting mechanism may also include a generally spherical joint fixed to the adjacent end of the driving shaft and a bifurcated rotary driver fixed to one end of the steering shaft. The rotary driver is coupled to the generally spherical joint rotatably with it and turnably on the horizontal axis, on which the steering shaft can tilt. The semispherical shell has a central hole formed through it, in which the rotary driver and the steering shaft are supported rotatably. Preferably, the semispherical shell can be fixed to the tilt housing in an arbitrary position around the horizontal axis by a pair of pivot members, a clamping device or the like.

After the operator turns the steering shaft with the semispherical shell to an upper or lower optimum position relative to the driving shaft, he or she can fix the semispherical shell to the tilt housing by tightening the pivot members, the clamping device or the like. With the steering shaft angled in the optimum position, the steering wheel can be turned with the steering and driving shafts to drive the pumping mechanism, which creates steering force for the vessel.

The parts of the tilting mechanism that extend backward from the dashboard are reduced in size to a minimum, and the mechanism is small. As a result, the tilting mechanism does not interfere with steering, and is very safe in case the vessel is in a collision. The oil feeding port is positioned in the upper portion of the tilt housing in the rear of the dashboard, so that the oil feeding and air bleeding operations are easy. It is possible to mount the steering apparatus on the dashboard with comparative ease in a short time by positioning the tilting mechanism and the hydraulic pump on both sides of the dashboard and connecting the tilt housing and the pump casing together.

BRIEF DESCRIPTION OF THE DRAWINGS

A preferred embodiment of the present invention is shown in the accompanying drawings, in which.

DETAILED DESCRIPTION OF A PREFERRED EMBODIMENT

Figure 1:
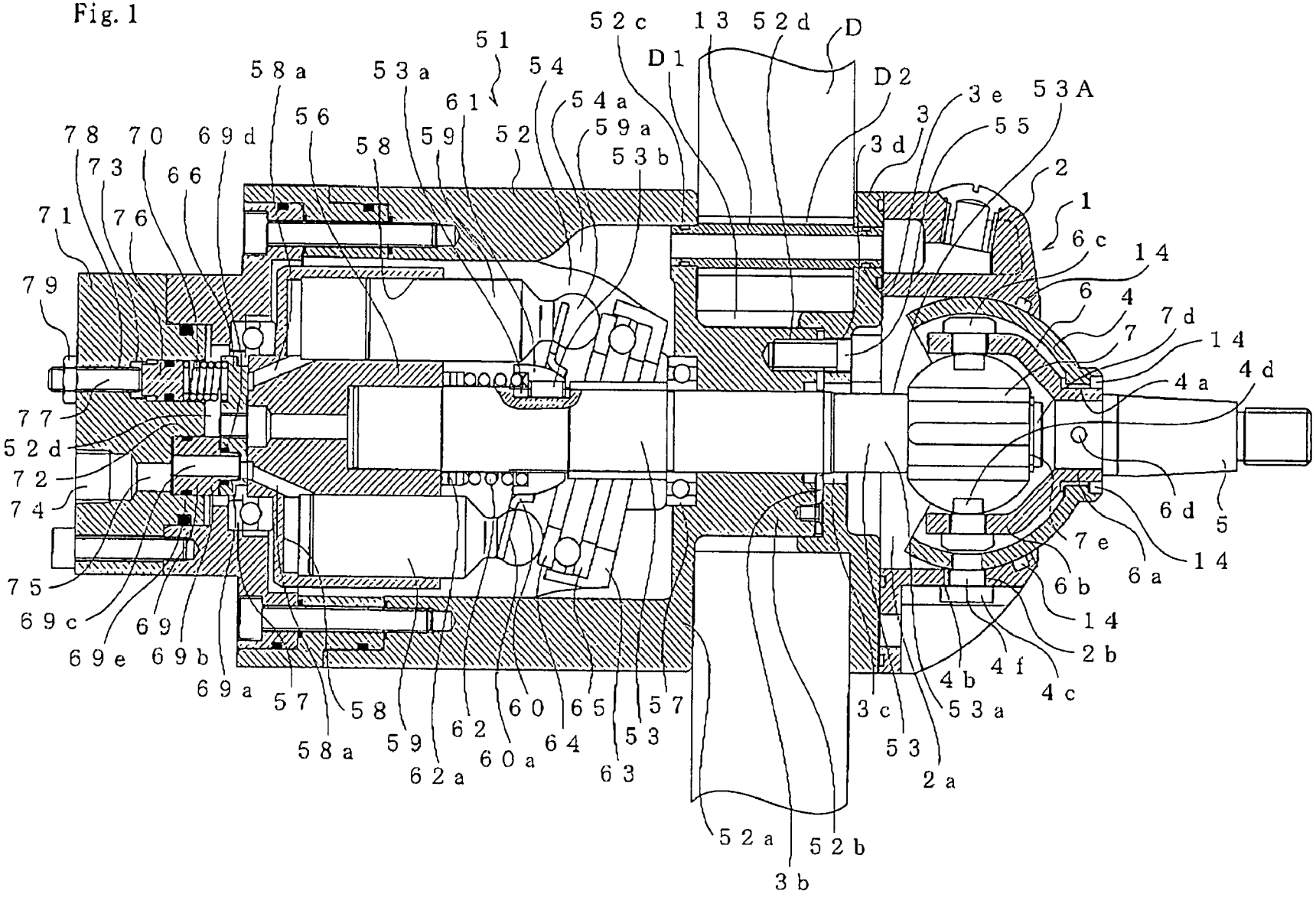
FIG. 1 is an axial section of part of a manual hydraulic steering apparatus embodying the present invention.

With reference to FIG. 1, a manual hydraulic steering apparatus embodying the present invention is mounted on the dashboard D of a vessel. The steering apparatus includes a helm pump 51 as a hydraulic pump and a tilting mechanism 1, which are positioned on the front and rear sides, respectively, of the dashboard D.

With reference to FIGS. 1 and 2*a*–2*c*, the tilting mechanism 1 has a tilt housing 2 generally circular in section and a mounting plate 3, which is fixed to the front end of the housing 2. The tilt housing 2 has a central opening 2*a* formed through it, which includes a semispherical seat. The mounting plate 3 has a cylindrical hub 3*a*extending forward. The cylindrical hub 3*a* has a central recess 3*b* formed in its frond end and a central hole 3*c* formed through it. The helm pump 51 has a driving shaft 53, which extends through the hub hole 3*c*. A semispherical shell 4 can slide on the semispherical seat of the tilt housing 2 in all directions. The semispherical shell 4 has a central rear opening 4*a* formed through it.

Figure 2A:
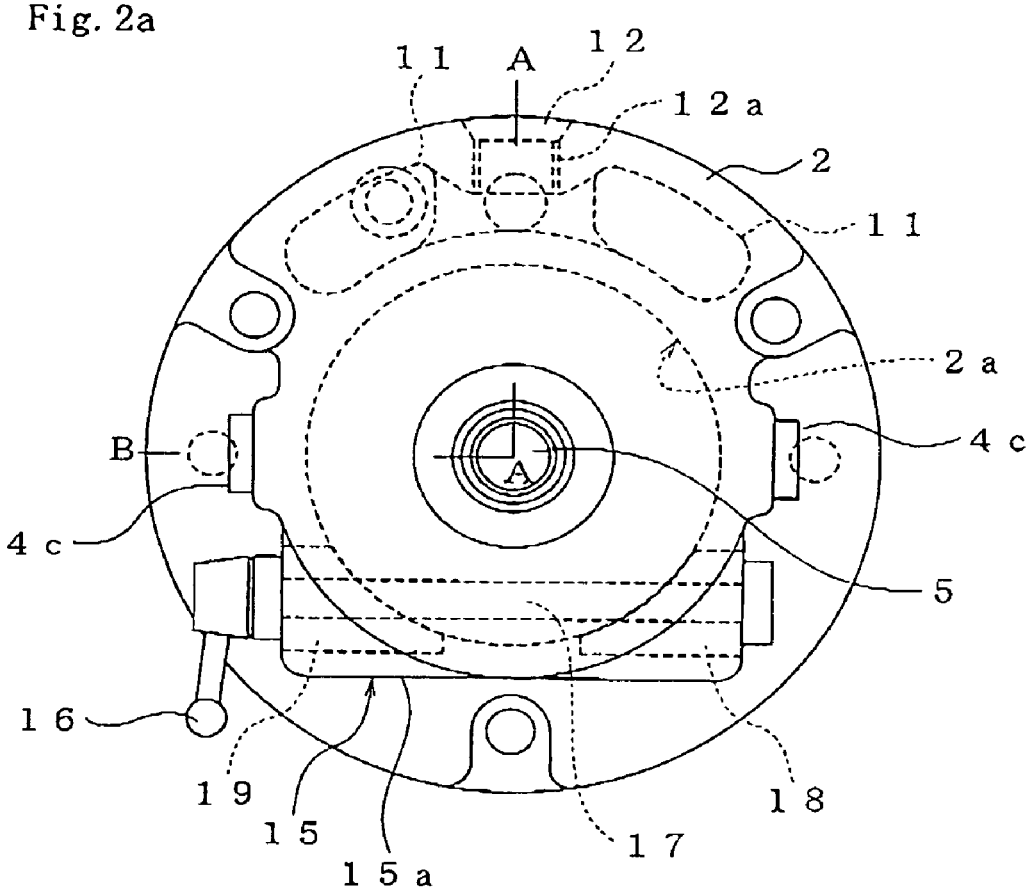
FIG. 2*a* is a rear end view of the tilting mechanism of the steering apparatus.
Figure 2B:
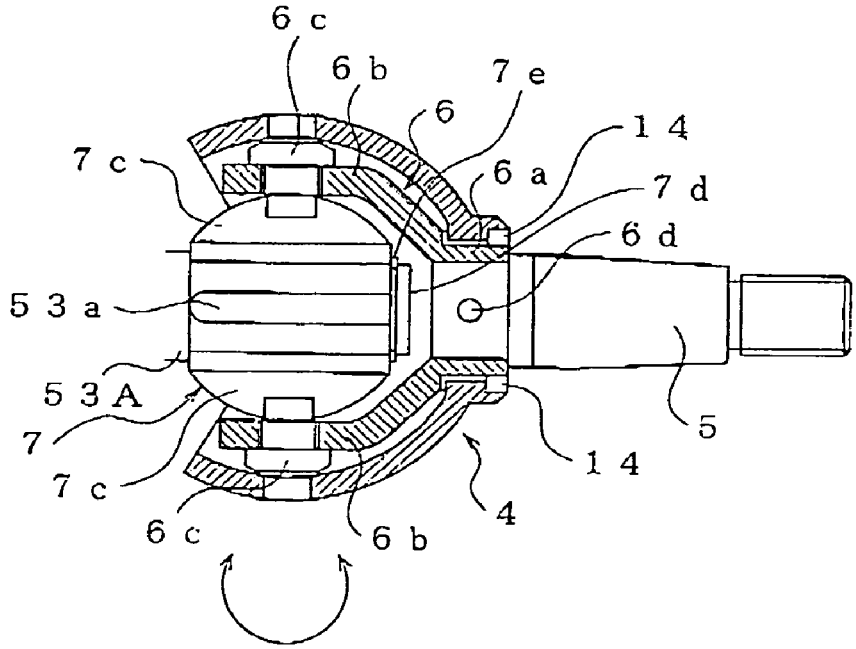
FIG. 2*b* is an axial section along line B—B of FIG. 2*a;*
Figure 2C:
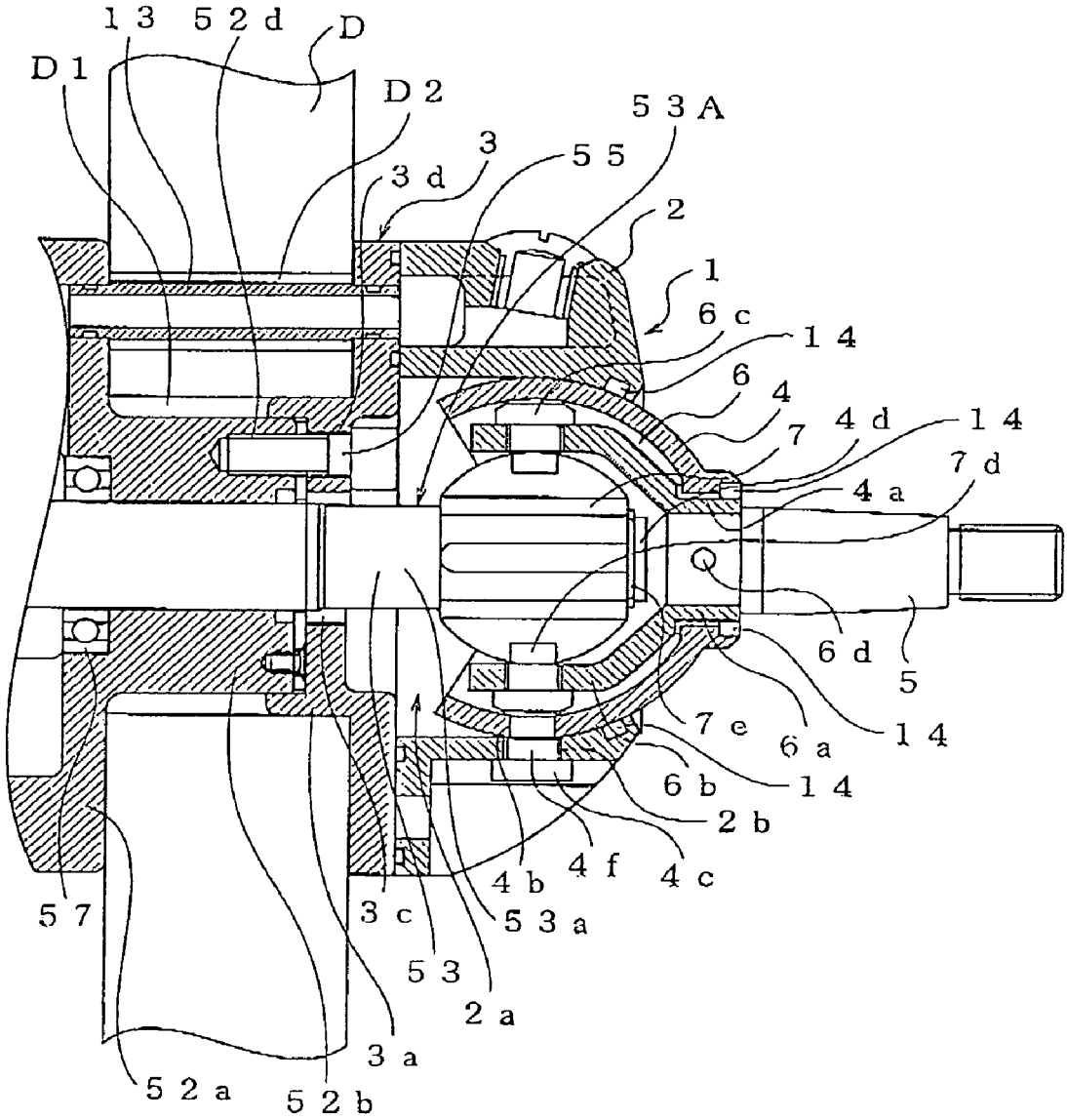
FIG. 2*c* is part of FIG. 1 and shows the tilting mechanism in section along line A–B of FIG. 2*a;*

A steering wheel (not shown) is fixed to the rear end of the steering shaft 5. The steering shaft 5 can rotate with a bifurcated rotary driver 6, which consists of a cylindrical hub 6*a* and a pair of arms 6*b*. The front end of the steering shaft 5 is inserted into the driver hub 6*a* and fixed to it with a spring pin 6*d*. The rotary driver 6 is coupled to the rear end of the driving shaft 53 by a generally spherical joint 7, which allows the rotary driver to rotate with the driving shaft and pivot or turn with respect to it. As shown in FIGS. 1, 2*b*, and 2*c*, each driver arm 6*b* has a tapped hole cut through it, which is coaxial with that of the other arm. Each of two pivot pins 6*c* is threaded externally between its head and bottom to engage with the tapped hole of one of the driver arms 6*b*.

Figure 3A:
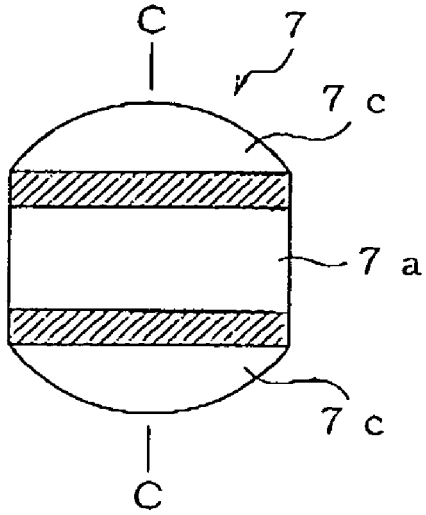
FIG. 3*a* is an axial section of the joint of the tilting mechanism, in section along line D—D of FIG. 3*b;*
Figure 3B:
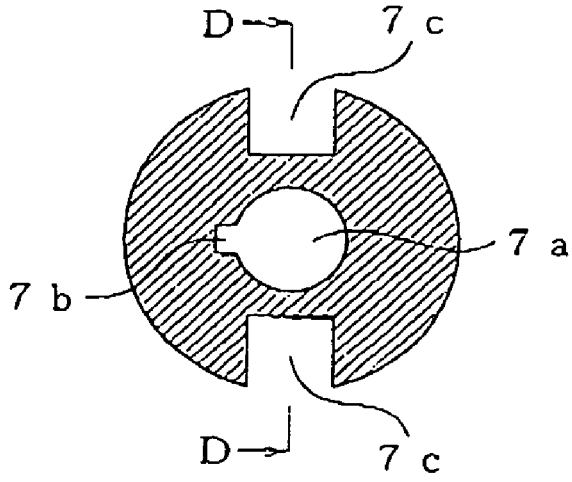
FIG. 3*b* is a radial section along line C—C of FIG. 3*a;*

As shown in FIGS. 3*a* and 3*b*, the generally spherical joint 7 has a central bore 7*a* formed through it with an axial key groove 7*b*. As shown in FIGS. 1, 2*b*, and 2*c*, a rear end part of the driving shaft 53 has an axial key 53*a* formed on its peripheral surface. The joint 7 is put on the rear end part of the driving shaft 53, with the key 53*a* engaging with the key groove 7*b*. The rear end of the driving shaft 53 is threaded externally for engagement with a nut 7*d* having a washer 7*e*. The nut 7*d* can be tightened to fix the joint 7 to the driving shaft 53. The joint 7 has two pin grooves 7*c* cut on diametrically opposite sides of the central bore 7*a*. The bottom of each pin groove 7*c* is parallel with the central bore 7*a*. Both sides of each pin groove 7*c* are semicircular The bottom of each pivot pin 6*c* engages slidably with one of the pin grooves 7*c*. Thus, the steering shaft 5 is coupled to the driving shaft 53 rotatably with it and tiltably on two tilt axes, which are perpendicular to each other and extend through the center of the joint 7. One of the tilt axes is radial of the driving shaft 53, and the other is coaxial with the pivot pins 6*c*. After the rotary driver 6 is coupled to the joint 7, the front end of the semispherical shell 4 is fitted around the driver hub 6*a*. Subsequently, the tilt housing 2 is fixed to the mounting plate 3.

The tilt housing 2 has two tapped holes 2*b* cut through its side walls. The tapped holes 2*b* have a common axis extending horizontally through the center of the generally spherical joint 7 and radially of the driving shaft 53. Each of two tilt pins 4*c* has an external thread 4*f* cut between its head and bottom 4*d*. The external thread 4*f* engages with one of the housing holes 2*b*. The semispherical shell 4 has two pin holes 4*b* cut through it, which have a common axis extending radially of the steering shaft 5. The bottom of each tilt pin 4*c* engages loosely with one of the pin holes 4*b* of the semispherical shell 4. This allows the semispherical shell 4 to turn on the horizontal axis of the housing holes 2*b*.

After the operator tilts the steering shaft 5 up or down to an optimum position, the tilt pins 4*c* could be tightened to fix the semispherical shell 4. In this embodiment, however, the semispherical shell 4 can be fixed by a clamping device 15. As shown in FIG. 2*a*, the clamping device 15 fitted on a lower portion of the tilt housing 2 and has a body 15*a*, a clamp lever 16 and a screw rod 17. In the device body 15*a*, an end portion of the screw rod 17 engages with a fixing shoe 18, and the screw rod 17 extends through another fixing shoe 19. The rotation of the clamp lever 16 in one direction rotates the screw rod 17 to move the shoes 18 and 19 toward each other into compressive contact with the semispherical shell 4. This makes it possible to fix the semispherical shell 4 in an arbitrary position. The rotation of the clamp lever 16 in the opposite direction rotates the screw rod 17 to move the shoes 18 and 19 out of contact with the semispherical shell 4. This allows the steering shaft 5 to shift with the semispherical shell 4 to another position. With the clamping device 15 loosened, the operator can move the steering wheel (not shown) to tilt the steering shaft 5 to an optimum position. Then, the operator can rotate the clamp lever 16 to fix the semispherical shell 4 in this position so that he or she can turn the steering wheel to steer the vessel.

As shown in FIGS. 1 and 2*c*, an annular seal 14 is interposed between the tilt housing 2 and semispherical shell 4. Another annular seal 14 is interposed between the rear end of the semispherical shell 4 and the hub 6*a* of the rotary driver 6. The annular seals 14 prevent drips of water from entering the tilting mechanism 1, so that this mechanism has a drip-proof structure.

As shown in FIG. 2*a*, the tilt housing 2 has an oil feeding tank 11 formed in its upper portion and extending in an arc on both its sides. An oil feeding pipe 13 extends from a left portion of the feeding tank 11 forward through the mounting plate 3. The tilt housing 2 also has an oil feeding port 12*a* formed in it and communicating with the top of a central portion of the feeding tank 11 and the outside of the tilt housing 2. The feeding port 12*a* is closed by an oil plug 12.

As shown in FIG. 1, the helm pump 51 has a casing 52 and an oil tank 54 formed in this casing. The front end of the oil feeding pipe 13 extends through an upper portion of the rear wall 52*a* of the pump casing 52 and communicates with the oil tank 54. The pump casing 52 has a cylindrical part 52*b* extending backward from the rear wall 52*a* to be seated in the central recess 3*b* of the mounting plate 3. A rear portion 53A of the driving shaft 53 extends through the casing part 52*b*. When the steering apparatus is mounted on the dashboard D, the shaft portion 53A is put through the central hole 3*c* of the mounting plate 3 into the circular opening 2*a* of the tilt housing 2. For this reason, the dashboard D has a large hole D1 and a small hole D2 formed through it. The large hole D1 is cut for the hub 3*a* of the mounting plate 3 and the cylindrical part 52*b* of the pump casing 52. The small hole D2 is cut for the oil feeding pipe 13. The oil tank 54 is formed near the rear end of the pump casing 52. An upper portion 54*a* of the oil tank 54 serves as an air accumulator, which communicates with the feeding pipe 13.

The cylindrical part 52*b* of the pump casing 52 has tapped holes 52*d* cut in its rear end. The cylindrical hub 3*a* of the mounting plate 3 has bolt holes 3*d* cut through it. With the casing part 52*b* seated in the central recess 3*b* of the mounting plate 3, bolts 55 are put through the bolt holes 3*d* and engage with the tapped holes 52*d*. The rear wall 52*a* of the pump casing 52 has a hole 52*c* formed through its upper portion. Likewise, the mounting plate 3 has a hole formed through its upper portion. The front end of the feeding pipe 13 is fixed in the casing hole 52*c*. The rear end of the feeding pipe 13 is inserted into the hole of the mounting plate 3 and fixed in it when the bolts 55 are tightened. Thus, the helm pump 51 and tilting mechanism 1 are connected together inside and outside the dashboard D, respectively.

The helm pump 51 has a cylinder block 56 as the main part of a cylinder mechanism. The cylinder block 56 is coupled to a front end portion of the driving shaft 53 to turn with this shaft. The cylinder block 56 and driving shaft 53 are supported rotatably by a front bearing 57 and a rear bearing 57, respectively, which are fitted in the pump casing 52.

The cylinder block 56 has cylinders 58, which may be five, six or seven in number, formed at regular intervals around its axis. The cylinders 58 extend axially of the cylinder block 56, and each have an open top at its rear end and a closed bottom near its front end. A pumping piston 59 is in axially slidable engagement with each cylinder 58 and has a head 59*a*. The driving shaft 53 has a key groove 53*a* formed in it, with which a key 53*b* is in axially slidable engagement. A spring seat 61 in the form of a sleeve can slide axially on the driving shaft 53 and engages with the key 53*b* to turn with this shaft. The spring seat 61 has a semispherical surface adjacent to its rear end. An annular piston retainer 60 can slide in all directions on the semispherical surface and has U-shaped outer recesses 60*a* formed through it at regular intervals around its axis. Each recess 60*a* engages with one of the piston heads 59*a*. The pumping pistons 59 are biased backward by a coil spring 62, which surrounds the driving shaft 53 and is interposed between the spring seat 61 and the rear end of the cylinder block 56. Spacers 62*a* are is interposed between the coil spring 62 and the rear end of the cylinder block 56.

An inclined bracket 63 is fixed in the pump casing 52 and near its rear end, and supports an inclined ball bearing. The top of the ball bearing is backward of the bottom of this bearing. The ball bearing has a fixed race 65 and a rotating race 64. The piston heads 59*a* are in compressive contact with the rotating race 64. When the driving shaft 53 turns with the cylinder block 56, pumping pistons 59 and piston retainer 60, the pistons 59 reciprocate axially.

Figure 4A:
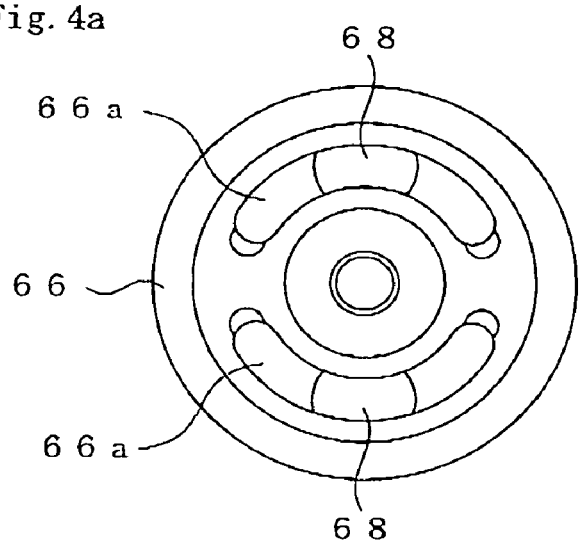
FIG. 4*a* is a rear view of the distributing valve of the helm pump of the steering apparatus.
Figure 4B:
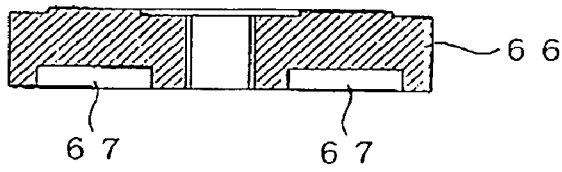
FIG. 4*b* is an axial section of the distributing valve along line B—B of FIG. 4*c;*
Figure 4C:
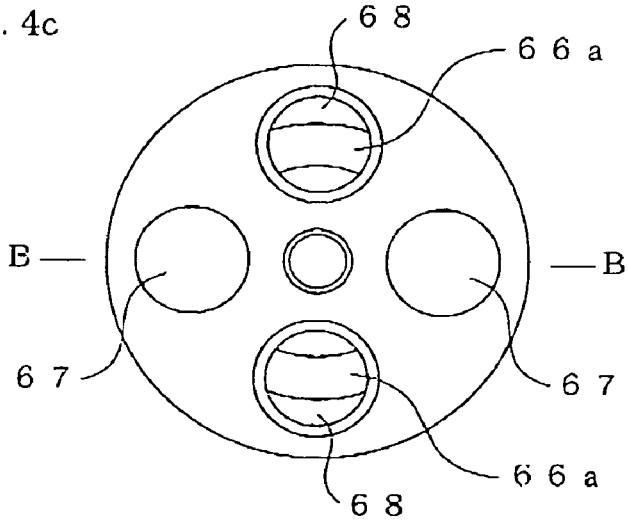
FIG. 4*c* is a front view of the distributing valve.

The cylinder block 56 has oil passages 58*a* formed through it, each of which extends between the bottom of one of the cylinders 58 and the front end of the cylinder block 56. The pump casing 52 has a front central hole 52*d* formed through it, in which a distributing valve 66 in the form of a disc is fitted. As best shown in FIG. 4*a*, the distributing valve 66 has a pair of arcuate ports 66*a* formed on its rear side diametrically opposite each other. One of the arcuate ports 66*a* communicates with some of the oil passages 58*a*, while the other port 66*a* communicates with other passages 58*a*. As best shown in FIG. 4*c*, the distributing valve 66 also has a pair of circular recesses 67 formed on its front side diametrically opposite each other and a pair of circular holes 68 formed on this side diametrically opposite each other. Each circular recess 67 is positioned at a right angle from each circular hole 68 around the center of the distributing valve 66. The front end of a coil spring 70 is seated in each circular recess 67. Each circular hole 68 communicates with one of the arcuate ports 66*a*. A pair of pressing pistons 69 each include a front cylindrical part 69*a* and a rear cylindrical part 69*b*, which is smaller in diameter than the front part 69*a*. Each pressing piston 69 has an oil passage 69*c* formed through both its parts 69*a* and 69*b*. The small part 69*a* of each pressing piston 69 is inserted into one of the circular holes 68 of the distributing valve 66, with an O-ring 69*d* interposed between this part and the valve.

A cylindrical end block 71 is bolted to the front end of the pump casing 52. The end block 71 has a pair of larger recesses 72 formed on its rear side diametrically opposite each other and a pair of smaller recesses 73 formed on this side diametrically opposite each other. Each larger recess 72 is positioned at a right angle from each smaller recess 73 around the axis of the end block 71. The front cylindrical part 69*b* of each pressing piston 69 is inserted into one of the larger recesses 72, with an O-ring 69*e* interposed between the piston 69 and end block 71. The end block 71 also has a pair of inlet/outlet ports 74 formed on its front side diametrically opposite each other. Each inlet/outlet port 74 communicates with one of the larger recesses 72 by means of an oil passage 75. A spring seat 76 is put slidably in each smaller recess 73. The front end of one of the coil springs 70 is in contact with the spring seat 76 to bias the distributing valve 66 backward. The end block 71 further has a pair of tapped holes 78 formed through it, each of which extends between the front ends of the end block 71 and one of the smaller recesses 73. An adjusting bolt 77 engages with each tapped hole 78. The rear end of the adjusting bolt 77 is in contact with the associated seat 76. The rotation of the adjusting bolt 77 adjusts the force of the associated spring 70. A fixing nut 79 engages with the adjusting bolt 77 and can be tightened to fix it.

As is the case with the conventional helm pumps, when the driving shaft 53 turns in one direction with the steering shaft 5, the cylinder block 56 turns to reciprocate the pumping pistons 59 axially. This causes pressure oil to be discharged from the helm pump 51 through one of the inlet/outlet ports 74 and sucked through the other into the pump.

While the helm pump 51 is operating, a hydraulic discharge pressure is applied on the rear end of the smaller cylindrical part 69*a* of one of the pressing pistons 69, and a hydraulic suction pressure is applied on the front end of the larger cylindrical part 69*b*of the other piston. Because the hydraulic pressures per unit area on the cylindrical parts 69*a* and 69*b* are equal, the suction pressure on the front end of the larger part 69*b* prevails over the discharge pressure on the rear end of the smaller part 69*a*, which is smaller in area than the front end. As a result, the distributing valve 66 is biased backward against the front end of the cylinder block 56.

While the steering shaft 5 is not turned, so that the helm pump 51 is not operating, no hydraulic pressure is applied on the pressing pistons 69. The coil springs 70 exert a relatively weak force on the distributing valve 66 to bias it backward against the front end of the cylinder block 56.

Thus, the helm pump 51 circulates the hydraulic oil in the steering apparatus by discharging part of the oil through one of the inlet/outlet ports 74 into the main unit (not shown) of the steering apparatus and sucking the other part of the oil from this unit through the other port to steer the vessel.

The pumping pistons 59 are biased backward at the same time by the single spring 62 and single retainer 60. The piston heads 59*a* engage with the retainer recesses 60*a*. Thus, the helm pump 51 requires only one coil spring for the pumping pistons 59 and is consequently simple in structure. There is no need to cut a spring hole for engaging with a coil spring in the body of each pumping piston 59. Air may accumulate in the spring holes in the pistons of the hydraulic pump of a conventional steering apparatus. The air accumulation may cause the discharge pressure of the hydraulic pump to act intermittently on the steering apparatus while the apparatus is operating. The pumping pistons 59 of the helm pump 51 have no such spring holes, where air might accumulate.

In a conventional hydraulic pump, a distributing valve is screwed to the rear end surface of its end block. The front end surface of the cylinder block of this pump, the front and rear surfaces of this valve, and the rear end surface of this block need finishing with very high accuracy to prevent oil leakage. The distributing valve 66 of the helm pump 51 is floating and biased against the front end of the cylinder block 56 by the hydraulic pressure created while the pump is operating, and by the auxiliary spring force. As a result, even if the distributing valve 66 etc. are finished with lower accuracy, oil leakage can be prevented reliably. This makes it possible to produce the pump more easily at lower cost.

As stated already, the oil feeding pipe 13 communicates with the top of the oil tank 54 in the helm pump 51. It is easy to feed the oil tank 54 with oil through the feeding pipe 13 from the oil feeding port 12*a* in the tilt housing 2. The oil feeding tank 11 in the tilt housing 2 communicates with the top of the oil tank 54 by means of the feeding pipe 13. Naturally, the air in the pump casing 52 moves to and accumulates in an upper portion of the feeding tank 11. This makes it possible to bleed air from the feeding port 12*a* by removing the oil plug 12.

The steering shaft 5 is supported tiltably on a horizontal axis by the tilt housing 2 as a main part of the tilting mechanism 1. The tilt housing 2 is simple in structure, having the oil feeding tank 11, the oil plug 12 and a means for coupling the steering shaft 5 to the rear portion 53A of the driving shaft 53. Accordingly, the tilt housing 2 is so compact that the distance between its rear end and the dashboard D can be shortened to a minimum. As a result, the tilt housing 2 as mounted on the dashboard D does not interfere with steering.

The pump casing 52 and tilt housing 2 are positioned on both sides of the dashboard D and can be mounted to it by being connected together. Accordingly, the pump casing 52 and tilt housing 2 can be mounted simply and securely by a small number of parts.

The helm pump 51 might be replaced by a conventional or general helm pump, or another hydraulic pump.

What is claimed is:

1. A manual hydraulic steering apparatus for a vessel fitted with a dashboard having a first hole and a second hole both cut therethrough, the steering apparatus comprising a tilting mechanism positioned on one side of the dashboard, a hydraulic pump positioned on the other side of the dashboard, and an oil feeding pipe extending through the second hole:

the tilting mechanism including:

a mounting plate in contact with the dashboard;

a tilt housing fixed to the mounting plate;

the tilt housing having an oil feeding tank formed in an upper portion thereof, the feeding tank having an oil feeding port;

an oil plug fitted removably in the feeding port;

a semispherical shell supported turnably in all directions by the tilt housing; and a steering shaft supported rotatably by the semispherical shell:

the hydraulic pump including:

a pump casing having a mounting part extending into the first hole of the dashboard;

an oil tank provided in an upper portion of the pump near the dashboard;

a pumping mechanism housed in the pump casing; and a driving shaft supported by the pump casing;

the driving shaft being rotatable so that the pumping mechanism can create hydraulic pressure for steering the vessel;

the driving shaft extending through the mounting part of the pump casing and the mounting plate of the tilting mechanism:

the feeding pipe communicating with the oil feeding tank and the oil tank:

wherein the mounting plate of the tilting mechanism is screwed to the mounting part of the pump casing, and wherein the steering shaft is coupled to the driving shaft rotatably with the driving shaft and tiltably on a horizontal axis perpendicular to the driving shaft.

2. The manual hydraulic steering apparatus of claim 1 wherein the tilting mechanism further includes:

a generally spherical joint fixed to the adjacent end of the driving shaft; and a bifurcated rotary driver fixed to one end of the steering shaft;

the rotary driver coupled to the generally spherical joint rotatably with the joint and turnably on the horizontal axis, on which the steering shaft can tilt;

the semispherical shell having a central hole formed therethrough;

the semispherical shell being able to be fixed to the tilt housing in an arbitrary position around the horizontal axis;

the rotary driver and the steering shaft supported rotatably in the central hole of the semispherical shell.

3. A tilting mechanism for a manual hydraulic steering apparatus for a vessel fitted with a dashboard having a first hole and a second hole both cut therethrough, the steering apparatus including a hydraulic pump positioned on one side of the dashboard, the hydraulic pump including a pump casing having a mounting part extending into the first hole of the dashboard, the hydraulic pump further including an oil tank formed in an upper portion thereof near the dashboard, the hydraulic pump further including a driving shaft extending through the mounting part, the tilting mechanism comprising:

a mounting plate for contact with the other side of the dashboard;

the mounting plate capable of being screwed to the mounting part of the pump casing, with the driving shaft extending through the mounting plate;

a tilt housing fixed to the mounting plate;

the tilt housing having an oil feeding tank formed in an upper portion thereof, the feeding tank capable of communicating with the oil tank through an oil feeding pipe extending through the second hole of the dashboard, the feeding tank having an oil feeding port;

an oil plug fitted removably in the feeding port;

a semispherical shell supported turnably in all directions by the tilt housing; and a steering shaft supported rotatably by the semispherical shell;

the steering shaft coupled to the driving shaft rotatably therewith and tiltably on a horizontal axis perpendicular to the driving shaft.

* * * * *